United States Patent [19]

Spang et al.

[11] 3,956,563

[45] May 11, 1976

[54] ASSEMBLY FOR APPLYING THIN DAMPING LAYERS IN BUILDING STRUCTURES

[75] Inventors: Kjell K. I. Spang, Vallingby; Gunnar I. Hagbjer, Stockholm; Jan Werner, Jarfalla; Goran R. Gadefelt, Farsta; Bo M. S. Egerborg, Ekero, all of Sweden

[73] Assignee: Akustikbyran AB, Stockholm, Sweden

[22] Filed: Aug. 7, 1973

[21] Appl. No.: 386,360

[30] Foreign Application Priority Data

Aug. 10, 1972 Sweden ..... 10387/72

[52] U.S. Cl. ..... 428/327; 52/309; 52/746; 181/33 GA; 156/71; 156/279; 428/331; 428/404; 428/409; 428/912

[51] Int. Cl.[2] ..... B32B 5/16

[58] Field of Search ..... 52/396, 408, 746, 309; 156/115, 71, 279; 161/164, 167, 213, 216, 217, 218, 219, 401, 405, 252, 253, 254, 202, 203, 204, 250, 145, 184, 186, 190, 114; 295/7; 181/1.5, 33 A, 33 G, 1 GA; 428/409, 461–463, 331, 150, 912, 520, 511–514, 402–404, 407, 323, 327

[56] References Cited

UNITED STATES PATENTS

| | | | |
|---|---|---|---|
| 2,663,663 | 12/1953 | Weltman et al. | 156/279 X |
| 2,768,923 | 10/1956 | Kepple et al. | 156/279 X |
| 2,827,098 | 3/1958 | Semegen et al. | 156/110 X |
| 3,562,089 | 2/1971 | Warnaka et al. | 161/217 X |
| 3,585,099 | 6/1971 | Buskirk | 428/402 X |
| 3,652,360 | 3/1972 | Hartman et al. | 161/401 X |

FOREIGN PATENTS OR APPLICATIONS

| | | |
|---|---|---|
| 344,093 | 3/1972 | Sweden |
| 192,515 | 11/1937 | Switzerland |

*Primary Examiner*—Harold Ansher
*Attorney, Agent, or Firm*—Pierce, Scheffler & Parker

[57] ABSTRACT

A noise-, and vibration-, damping article for use in a building structure is a laminated composite consisting essentially of a backing strip which on each of its two sides is provided with a damping layer comprising a viscoelastic material. At least one of said damping layers includes a granular material receptive to bonding with a material of the building structure.

4 Claims, 2 Drawing Figures

ASSEMBLY FOR APPLYING THIN DAMPING LAYERS IN BUILDING STRUCTURES

Figure 1:
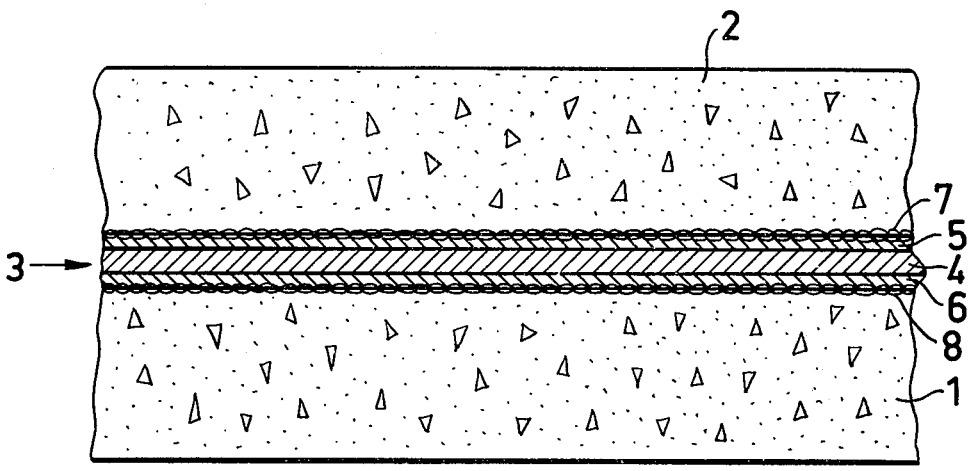

This invention relates to a prefabricated article for applying thin damping layers in building structures. The term building structure in this conjunction comprises structures of concrete, lightweight concrete and similar material, such as plaster.

When a very thin layer of a suitable material is applied within a structure of concrete or lightweight concrete, this structure is given a very high internal damping. A structure of this kind is described in the Swedish Pat. No. 344 093, in which structure at least one layer of a viscoelastic material is provided which at shearing absorbs substantial energy. This layer is very thin in relation to the thickness of the structure.

A practically applicable form of material having those properties, which are required for a good damping effect within the frequency ranges concerned, are prefabricated thin viscoelastic layers, for example of foil form. Such layers, however, have a low strength and, besides, are difficult to handle because of their low rigidity. In order to effect adhesion on concrete or other similar material, it is necessary to glue the viscoelastic layers thereto. This is possible only in the application to prefabricated structural elements, but the glueing cannot be carried out before the concrete has solidified. It is possible, certainly, to obtain a higher mechanical resistance and even a higher rigidity by increasing the viscoelastic layer thickness, but thereby the damping effect for the material here concerned decreases. The layer material, besides, is relatively expensive, so that it is economically desirable to be able to utilize thin layers.

The present invention has as its object to solve the aforesaid problems. This object is achieved by the damping article according to the invention, which has been given the characterizing features defined in the claims.

The damping article according to the invention can advantageously be prefabricated, for example in the form of webs, in which the backing, for example, may be a foil, fabric or cardboard permitting the damping article to be delivered to the building site in the form of rolls, or in the form of plates, in which case the backing may consist, for example, of a particle board, a concrete slab or a metal sheet. Both of these embodiments can be applied to the casting of plane structures, but the plate embodiment is particularly applicable to vertical casting in situ.

The utilization of the special backing for the damping layer material solves the problem of the low strength. The damping layer is provided with a layer receptive to bonding, which consists of a material providing a larger total surface in the form of granular material which provides good adherence to or within concrete, whereby the damping article can adhere to concrete which has not solidified.

The principle of the manufacture of the damping article is as follows. On one or both surfaces of a backing strip, for example plastic foil, fabric, cardboard, particle board or metal sheet, a thin layer of the damping layer material in question is applied. (When the backing is a fabric, it is understood that the damping layer material also is found within the fabric proper, i.e. between its threads or corresponding parts). The damping layer material may consist of an adhesive plastic of a two-component type. Prior to the hardening or drying of the layer, a layer of material which is receptive to bonding; for example sand, gravel or the like, is spread onto the damping material layer and adheres to the concrete when being cast. As damping layer material also other materials may be used. When a damping article is to be manufactured for application to prefabricated concrete elements, which lateron will be provided with additional concrete layers, for example in the pouring of structural concrete on concrete framing of joists, the damping layer can be provided with adhesive layer material only on that surface, which is remote from the prefabricated element.

The invention is described below, with reference to the drawing, in which

Figure 2:
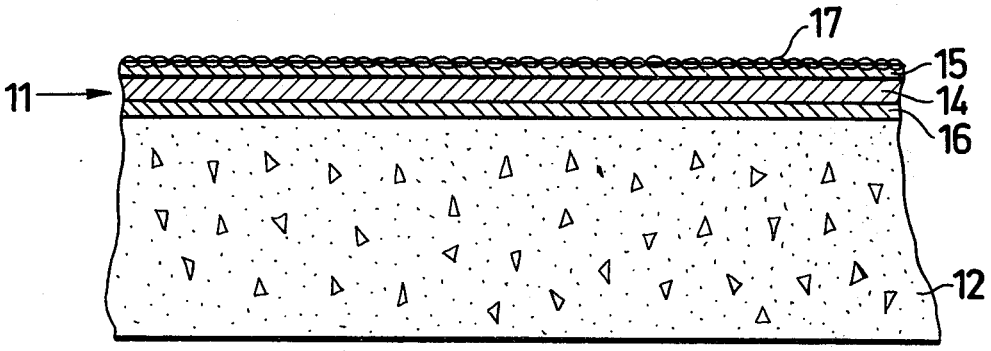

FIG. 1 shows in section a concrete structure with a cast-in prefabricated damping article, and FIG. 2 shows also in section a damping article applied on a prefabricated concrete element.

The structure shown in FIG. 1 comprises a lower concrete slab part 1 and an upper concrete slab part 2. Between said slabs a damping article 3 according to the invention is applied which assembly consists of a backing strip 4 of foil form, for example of polyvinylchloride. On each side of the backing strip damping layers 5 and 6, respectively, are applied. The damping layer consists, for example, of an adhesive plastic of a two-component type onto which prior to the hardening thereof layers 7 and 8, respectively, of sand grains or the like have been spread or applied in another manner which, thus, to a greater or lesser degree, are embedded in and protrude from the damping layers.

A damping article thus composed is sufficiently rigid after the solidification of the damping layers to be handled easily, but sufficiently flexible to be stored and transported in the form of rolls and to be applied onto curved surfaces.

Subsequent to the casting of the lower slab part 1, but before the concrete has started to solidify, the damping article 3 is applied thereon, whereafter the concrete slab part 2 is poured over the damping article. Hereby the portions of sand grains or the like projecting out of the damping layer are case into the concrete, whereby after the solidification of the concrete a good connection is obtained between the concrete slabs and the respective damping layers. Such good connection is necessary in order to transfer the energy supplied to the slab by vibration (bending vibration) to shearing in the damping layers and in order thereby to absorb to a large extent said energy.

The damping article 11 shown in FIG. 2 is applied on a prefabricated concrete or lightweight concrete slab 12. The backing strip 14 is provided on both sides with damping layers 15 and 16, respectively, of which only the damping layer 15 remote from the slab has been provided with a layer 17 of sand or the like receptive to bonding while the layer 16 has been glued directly onto the dry surface of the slab 12.

Tests have proved that concrete structures, in which damping articles are applied according to the invention achieve a damping as good as that achieved by structures disclosed in the aforementioned Swedish Pat. No. 344,093.

What we claim is:

1. A prefabricated article for applying thin damping layers in building structures which comprises a backing strip, a thin damping layer of viscoelastic material on both sides of the backing strip and, on at least one of the damping layers, a layer of granular material embedded in and protruding from the viscoelastic layer and providing a surface receptive to bonding with a building material to be cast thereagainst.

2. An article as defined in claim 16 in which both damping layers include layers of embedded and protruding granular material.

3. An article according to claim 1, wherein the backing strip is composed of a flexible web material selected from the group consisting of polyvinylchloride foil, woven fabric and cardboard.

4. An article according to claim 1, in which said granular material is sand.

* * * * *